US008747183B2

(12) United States Patent
Chen

(10) Patent No.: US 8,747,183 B2
(45) Date of Patent: Jun. 10, 2014

(54) PLAYHOUSE KIT

(76) Inventor: Samuel Chen, Shanghai (CN)

( * ) Notice: Subject to any disclaimer, the term of this patent is extended or adjusted under 35 U.S.C. 154(b) by 125 days.

(21) Appl. No.: 13/449,250

(22) Filed: Jun. 15, 2012

(65) Prior Publication Data

US 2013/0337926 A1 Dec. 19, 2013

(51) Int. Cl.
*A63H 3/52* (2006.01)
*A63H 3/00* (2006.01)

(52) U.S. Cl.
USPC ..... 446/478; 52/582.1

(58) Field of Classification Search
USPC ..... 446/105, 176, 478; 52/79.12, 79.9, 281, 52/284, 282.1, 282.4, 285.1, 285.2, 582.1
See application file for complete search history.

(56) References Cited

U.S. PATENT DOCUMENTS 6,006,480 A * 12/1999 Rook ..... 52/309.12
6,145,257 A * 11/2000 Cappuccio ..... 52/220.2
6,253,516 B1 * 7/2001 D'Andrea et al. ..... 52/582.1
6,272,802 B1 * 8/2001 Berberich ..... 52/233
6,463,705 B1 * 10/2002 Davis et al. ..... 52/143
7,194,844 B2 * 3/2007 Dennis ..... 52/582.1

* cited by examiner

*Primary Examiner* — Kien Nguyen
(74) *Attorney, Agent, or Firm* — Clement Cheng

(57) ABSTRACT

A playhouse kit has a first panel of planar shape; a first rail of linear shape; a first panel connector connecting the first panel to the first rail along a first vertical edge of the first panel; a second panel of planar shape; a second rail of linear shape; a second panel connector connecting the second panel to the second rail along a second vertical edge of the second panel; a third panel; a third rail; a third panel connector connecting the third rail to the third panel; a corner post, the corner post having a corner third panel predrilled hole row aligned for connecting the corner post with the third panel, the corner post having a corner first panel predrilled hole row for connecting the corner post with the first panel; and a container housing the first panel, second panel, and third panel arranged in a stacked configuration.

12 Claims, 4 Drawing Sheets

PLAYHOUSE KIT

DISCUSSION OF RELATED ART

The child playhouse has been made in a wide variety of different constructions including indoor playhouse and outdoor playhouse kits. The most rudimentary child playhouse has often been a large cardboard box left over from a shipment of a large appliances such as a refrigerator. Other children's structures have been described in the art including United States patents.

For example, in U.S. Pat. No. 5,706,613, inventor Drake creates a walk-in child playhouse having pivotally attached seating surfaces. In one embodiment, the walk-in child playhouse comprises an enclosed rotomolded plastic structure having walls, a roof, and at least one chair or seat member pivotally attached to the playhouse. In another embodiment, the playhouse comprises of a lateral connection member for joining various wall panels at a lower portion.

In U.S. Pat. No. 4,964,249, inventor Payne creates a foldable children's playhouse having a box beam integral with one or two roof panels is closed . . . . In a preferred embodiment, walls of the playhouse are made up of two units, each including a rectangular side wall and an end wall having a rectangular bottom portion and a triangular gable portion that folds along the top of the bottom portion. In U.S. Pat. No. 3,729,881, inventor Disko's playhouse is comprised of a plurality of different panel members and a plurality of different upright and horizontal mullion or frame members. Frame interlocking or coupling members, generally indicated are provided on some frame members to hold the frame members together in a grid-like framework for receiving the panels there between. In U.S. Pat. No. 5,301,478, inventor Maese Jr's child's playhouse includes interfolded panels arranged for ease of assembly relative to one another, including hinged interconnection, wherein the top wall includes a pop-up plate and the top wall to provide for ease of projection of a structure relative to the top wall.

SUMMARY OF THE INVENTION

A playhouse kit has a first panel of planar shape; a first rail of linear shape; a first panel connector connecting the first panel to the first rail along a first vertical edge of the first panel; a second panel of planar shape; a second rail of linear shape; a second panel connector connecting the second panel to the second rail along a second vertical edge of the second panel; a third panel; a third rail; a third panel connector connecting the third rail to the third panel; a corner post, the corner post having a corner third panel predrilled hole row aligned for connecting the corner post with the third panel, the corner post having a corner first panel predrilled hole row for connecting the corner post with the first panel; and a container housing the first panel, second panel, and third panel arranged in a stacked configuration.

Optionally, the first panel is made of a plurality of parallel boards oriented perpendicular to the first rail. Each of the plurality of parallel boards is attached to the first rail. The first rail can be an inner rail and the second rail can be an outer rail with a first vertical row of predrilled holes extending through the first rail and a second vertical row of predrilled holes extending through the first rail. On the other hand, the second rail can be an inner rail and the first rail can be an outer rail with a first vertical row of predrilled holes extending through the second rail and with a second vertical row of predrilled holes extending through the second rail. The playhouse is preferably configured for a 2×3 configuration with a total of ten panels and ten junctions. The 10 junctions would include four corner panel junctions and six linear panel junctions.

Figure 1:
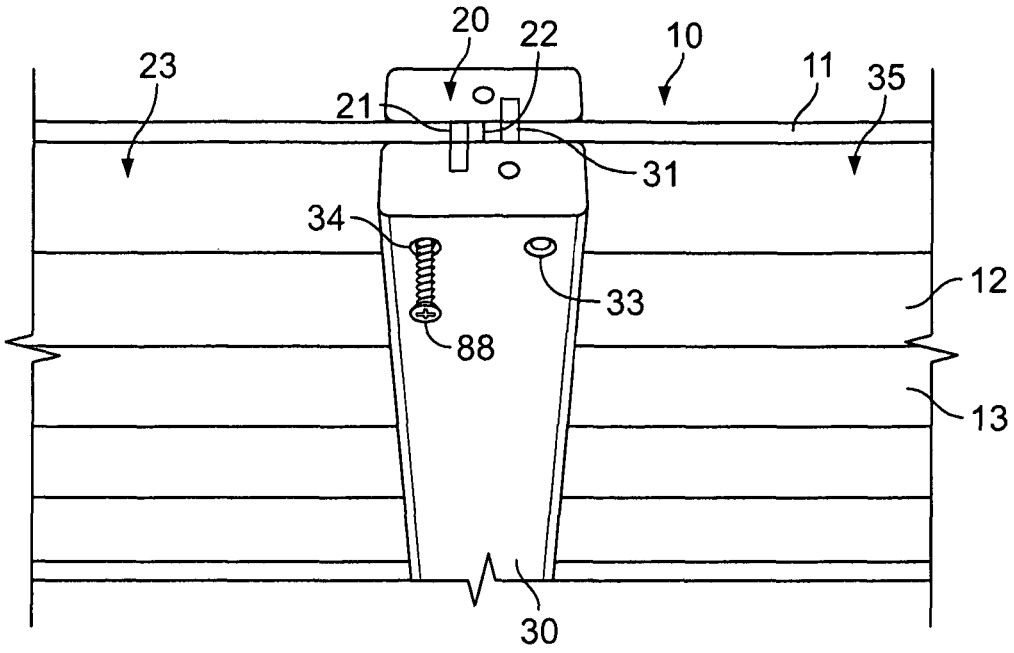
FIG. 1 is a downward view showing connection of a first panel to a second panel.
Figure 2:
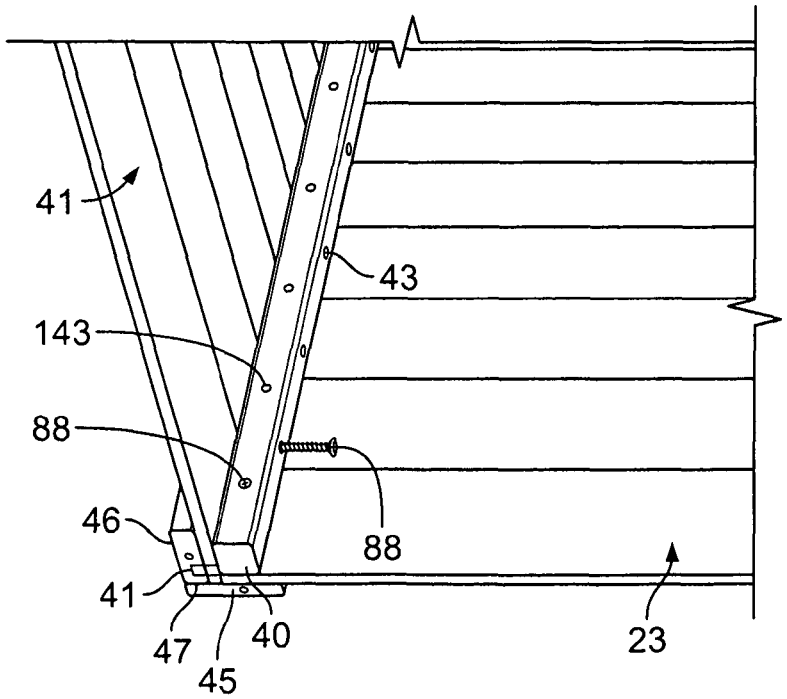
FIG. 2 is a upward view showing connection of a first panel to a third panel.
Figure 3:
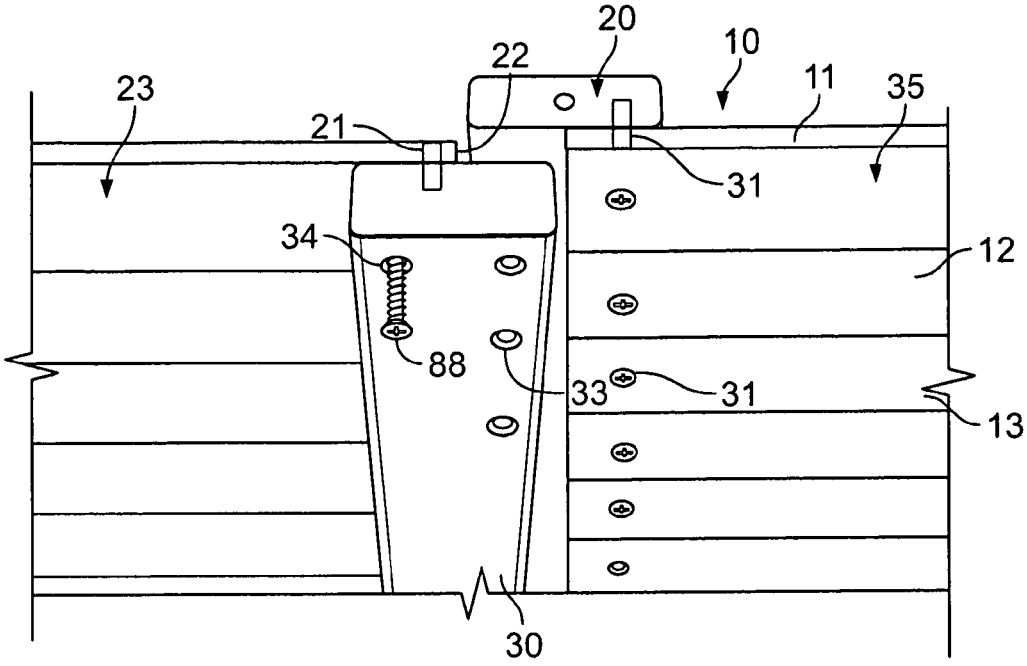
FIG. 3 is a downward view showing connection of a first panel to a second panel in exploded view.
Figure 4:
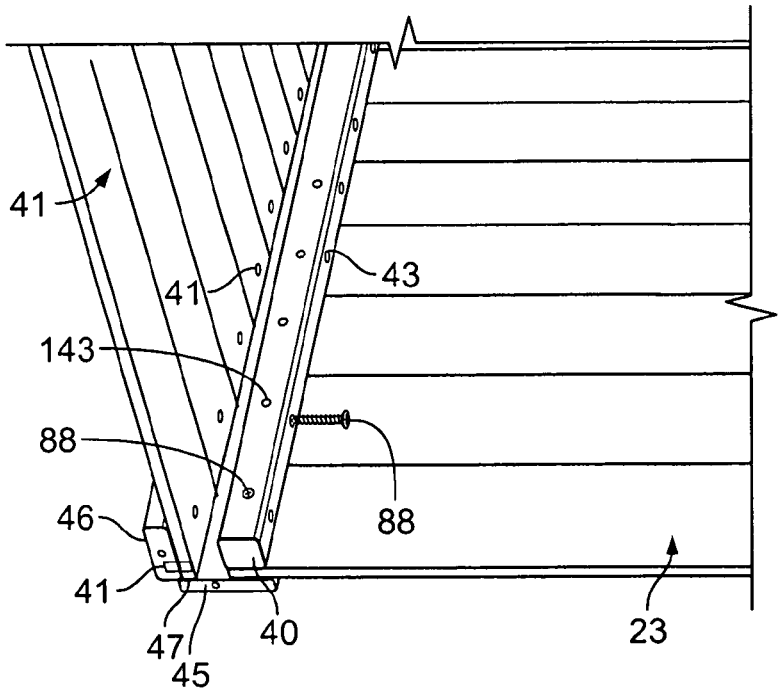
FIG. 4 is a upward view showing connection of a first panel to a third panel in exploded view.
Figure 5:
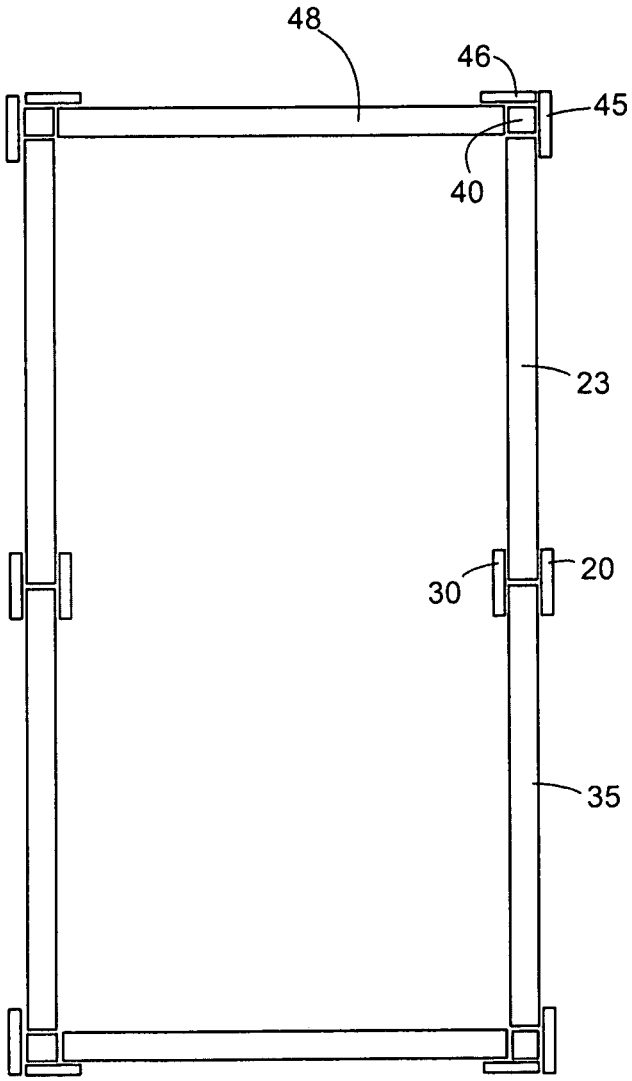
FIG. 5 is a diagram showing connection of all panels from a top view in a 1×2 panel configuration.
Figure 6:
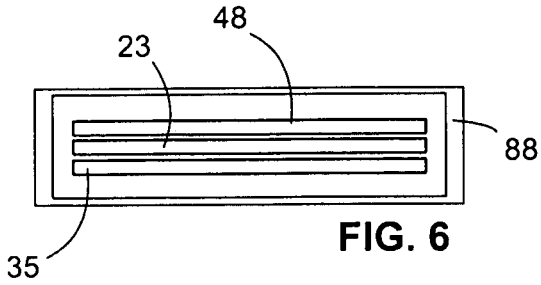
FIG. 6 is a diagram showing packaging of panels in a container.
Figure 7:
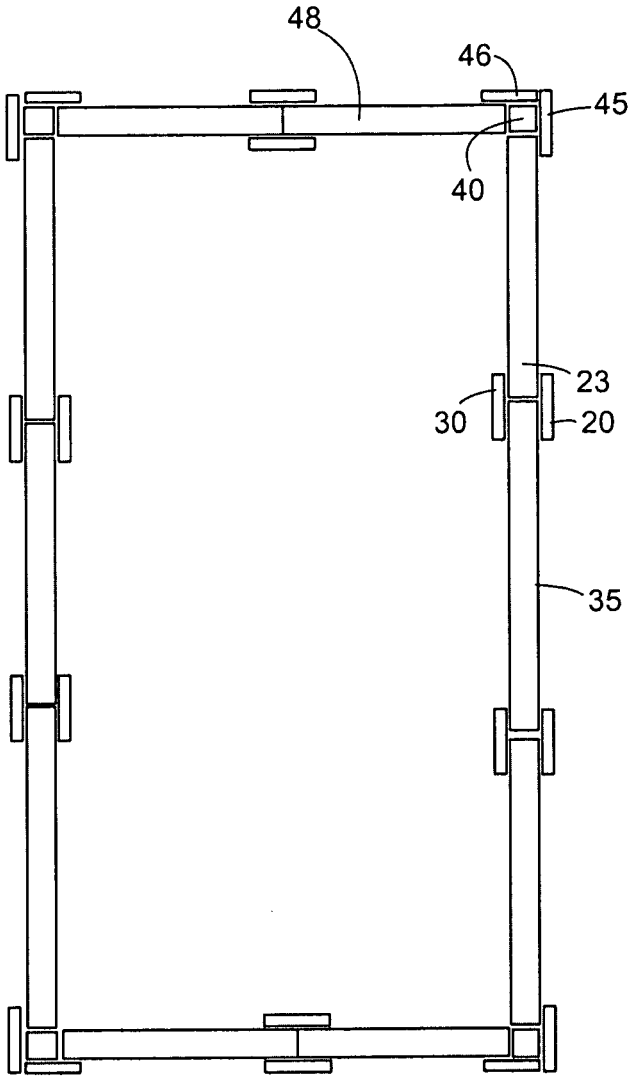
FIG. 7 is a diagram showing connection of all panels from a top view in a 2×3 panel configuration.

The following call out list of elements is a useful guide in referencing the elements of the drawings.

10 Panel
11 Outside Panel Board
12 Inner Panel Board
13 Lower Panel Board
20 Outside Rail
21 First Panel Connector
22 Panel Bisection
23 First Panel
30 Inner Rail
31 Second Panel Connector
33 Second Panel Predrilled Hole Row
34 First Panel Predrilled Hole Row
35 Second Panel
40 Corner Post
41 Third Panel Connector
43 Corner Third Panel Predrilled Hole Row
143 Corner First Panel Predrilled Hole Row
45 First Corner Board
46 Second Corner Board
47 Corner Ledge
48 Third Panel
88 Screw Connector

DETAILED DESCRIPTION OF THE PREFERRED EMBODIMENT

According to the preferred embodiment of the present invention a vertical wall portion of a playhouse kit can be constructed by connecting boards and rails. The boards and rails are typically made of painted wood that have been cut, sanded, finished and painted. The boards and rails can also be made of plastic or a plastic parts to them.

Linear panels 10 can be connected to each other in a linear connection by a sandwich joint. The outside panel board 11 can first be connected to an outer rail. The inner panel board 12 can also be connected to the outer rail. A lower panel board 13 can also be connected to the outer rail 20. The second panel connector 31 connects the outer rail 22 the second panel 35. A row of second panel connectors 31 run the length of the outside rail 20. The second panel connector 31 can be a screw that starts from a surface of the second panel 35. The second panel 35 is made of a number of parallel boards.

The first panel connector 21 connects the first panel 23 to the inner rail 30. The first panel 23 is also made of a number of parallel boards. The parallel boards form a panel and are connected preferably by driving a screw from an outside surface of the first panel through the first panel and at least partially into the inner rail 30. It is preferred that each board is connected to the inner rail 30 by a single screw connector 88. The first panel connector 21 preferably can be a screw connector 88. The first panel connector 21 can also be a nail or a staple. The inner rail 30 can be made of the same dimension as the outside rail 20.

The inner rail 30 could also be attached to the other panel, namely the second panel rather than the first panel. Similarly, the outer rail can be connected to the first panel rather than the second panel. In any case, the first panel is connected to the first rail in the second panel is connected to the second rail. The first rail can be the inside rail or the outside rail. The second rail can be the inside rail or the outside rail. The inside rail cooperates with the outside rail to sandwich of the first panel and the second panel. A panel can be made to be fifteen parallel boards high.

The second panel also has second panel predrilled holes align in a second panel predrilled hole row 33. The inner rail 30 has second panel predrilled holes aligned in a second panel predrilled hole row 33 so that the predrilled holes extend through the inner rail, then the second panel, and optionally a portion of the way through the outside rail. The predrilled holes allow a user to insert connectors such as a screw connector 88, or a nail. The second panel predrilled hole row 33 preferably has a bevel edge to receive an angled profile of a screw head.

The second panel has a pair of vertical rows of predrilled holes including a first panel predrilled hole row 34 and a second panel predrilled hole row 33. The pair of vertical rows of predrilled holes start from the inside surface of the inner rail 30 and extend outward through the respective panels and optionally into the outside rail 20.

At a factory, the boards are attached to the rails. The boards of the first panel 23 are attached to the inner rail 30 using a vertical row of first panel connectors 21. The boards of the second panel 35 are connected to the outside rail 20 using a vertical row of second panel connectors 31. The boards making the panels are then shipped flat and stacked for packaging.

A user opens the package and aligns the first panel to the second panel at the panel bisection 22. The outside rail 20 forms a shoulder to receive the first panel 23 and the inside rail 30 forms a shoulder to receive the second panel 35. The user then secures the outside rail to the inside rail and secures the outside rail to the first panel by driving a screw connector 88 through a first panel predrilled hole. If multiple first panel predrilled holes are required, they can be aligned in a row to form a first panel predrilled hole row 34. The user also drives a screw connector 88 through the second panel predrilled hole to attach the outside rail 22 the inside rail 30 and to attach the inside rail 30 to the second panel 35. If multiple second panel predrilled holes are required, they can be aligned in a row to form a second panel predrilled hole row 33.

Typically, a playhouse will have several panels. The preferred embodiment playhouse has a total of eight panels. The playhouse is two panels wide by three panels long. A playhouse can also be one panel wide by two panels long. Panels need not be of the same dimensions, but it is preferred that panels are of approximately the same dimensions.

The playhouse will also require corner connections. The user can then make a corner connection that will connect the first panel 23 to the third panel 48. The corner connection is also a sandwich connection which connects the first panel 23 to a corner post 40 and connects the first panel 23 to a first corner board 45. The first corner board 45 receives screws extending from an inside surface of the first panel 23 and into the first corner board 45.

The third panel 48 as a plurality of third panel connectors 41 that are preferably screws and connect each parallel board of the third panel 48 to the second corner board 46. The end of the boards of the third panel 48 are substantially flush with the outside edge of the second corner board 46. The end of the first corner board 45 is designed to receive the second corner board 46 and the boards of the third panel 48. The first corner board 45 is connected to each board of the first panel 23 to have an offset equal to the thickness of the second corner board 46 plus the thickness of the boards of the third panel.

The corner post 40 is connected to either the first panel or the third panel. Preferably, the corner post 40 is connected to the first panel 23. The first panel 23 is connected to the third panel at the corner post 40. The first panel 23 was initially connected to the first corner board 45 using small screws starting on the inside face of the first panel 23. The first panel 23 then also receives a corner post 40 with screws starting from an inside surface of the corner post 40. Thus, the first panel 23 has a pair of screws normal to it, namely a set of smaller screws and a set of longer screws. The corner post receives a corner third panel predrilled hole row 43 extending along the length of the corner post 40. The corner post also receives a corner first panel predrilled hole row 143 extending along the length of the corner post 40.

After drilling the rows of holes, the third panel having the second corner board 46 attached is packed flat with the first panel having the first corner board 45 attached. The first panel or the third panel may have a corner post attached. Then screw connectors 88 and extend from the corner post 40 into the first panel 23 and preferably also extend into the first corner board 45. A single screw connector is enough to connect the corner post 40 of the first panel to the third panel.

When a user opens the package and unpacks the contents, the user can drive a number of screw connectors 88 into the corner third panel predrilled hole row 43 to provide a quick connection between the first panel and third panel.

In the present embodiment, a user need only drive a screw connector through a second panel predrilled hole and a first panel predrilled hole to connect the first panel to the second panel. A user need only drive a screw connector through a third panel predrilled hole to connect the third panel to the first panel.

The row of predrilled holes for receiving screw connectors can be a row of two elements, namely an upper hole and a lower hole. If a row of two elements can be implemented, a pair of long screw connectors is sufficient for connecting the first panel to the third panel, and four long screw connectors are sufficient for connecting the first panel to the second panel. In a playhouse having a total of eight panels that is two panels wide by three panels long, the playhouse will require four linear connections and four corner connections. Each linear connection requires a total of four screw connectors and each corner connection requires a total of two screw connectors such that a user need only drive a total of 32 screws to assemble the vertical panel portion of the playhouse. It is preferred that total assembly can be completed in less than one hour. More screws are implemented for additional strength.

In a slightly different embodiment of the present invention, the corner post is not connected to the first panel or the third panel at the factory and the corner post requires at least four connectors through predrilled holes. The corner post may have a corner third panel predrilled hole row aligned for connecting the corner post with the third panel. Also, the corner post may have a corner first panel predrilled hole row for connecting the corner post with the first panel.

It is preferred to have four long screws for each predrilled hole row. It is preferred to have a pair of predrilled hole rose for each corner connection and for each linear connection. A total of 10 connections are made by the end-user assembling on site and each connection preferably has eight long screws. A total of 80 pre-drilled holes is the preferred embodiment for the vertical panel portion of the playhouse that is two panels wide by three panels long or three panels wide by two panels long. The user preferably needs to drive 80 screws into 80 predrilled holes.

The first panel plus the second panel plus the third panel constitute half of the vertical wall portion of the playhouse in a 1×2 configuration. The first half of the vertical wall portion of the playhouse can be connected to the second half of the vertical wall portion of the playhouse. A user can make the second half of the vertical wall portion of a 1×2 playhouse using the same steps as stated above.

The panels of the playhouse may also have windows, doors and other decorative elements attached. The panels of the playhouse when assembled to stand vertically should be able to hold a pair of roof panels. The panels of the playhouse may not all be perfectly rectangular and some may have decorative elements.

The terminology of rows and vertical rows is used rather than vertical columns of predrilled holes since the playhouse kit is shipped flat and the predrilled holes would be drilled in rows at the factory. Thus, the terminology of rows refers to the orientation of the workpiece during construction. This is for facilitating enablement of the present invention.

The invention claimed is:

1. A playhouse kit comprising:

a. a first panel of planar shape;

b. a first rail of linear shape;

c. a first panel connector connecting the first panel to the first rail along a first vertical edge of the first panel;

d. a second panel of planar shape;

e. a second rail of linear shape;

a second panel connector connecting the second panel to the second rail along, a second vertical edge of the second panel;

g. a third panel;

h. a third rail;

i. a third panel connector connecting the third rail to the third panel;

j. a corner post, the corner post having a corner third panel predrilled hole row aligned for connecting the corner post with the third panel, the corner post having a corner first panel predrilled hole row for connecting the corner post with the first panel, wherein the corner post makes a corner connection that is also a sandwich connection which connects the first panel to the corner post and which connects the first panel to a first corner board; and k. a container housing the first panel, second panel, and third panel arranged in a stacked configuration, wherein the second panel predrilled hole aliens with the first rail and the second rail and is configured to receive a screw connector to pass through the first rail and the second rail to attach an inside rail to the second panel.

2. The playhouse kit of claim 1, wherein the first panel is made of a plurality of parallel boards oriented perpendicular to the first rail, wherein each of the plurality of parallel hoards is attached to the first rail.

3. The playhouse kit of claim 1, wherein the first rail is an inner rail and wherein the second rail is an outer rail.

4. The playhouse kit of claim 3, further comprising a first vertical row of predrilled holes extending through the first rail and further comprising a second vertical row of predrilled holes extending through the first rail.

5. The playhouse kit of claim 1, wherein the second rail is an inner rail and wherein the first rail is an outer rail.

6. The playhouse kit of claim 5, further comprising a first vertical row of predrilled holes extending through the second rail and further comprising a second vertical row of predrilled holes extending through the second rail.

7. The playhouse kit of claim 1, wherein the playhouse is configured for a 2×3 configuration with a total of ten panels and ten junctions.

8. The playhouse kit of claim 7, wherein the first panel is made of a plurality of parallel boards oriented perpendicular to the first rail, wherein each of the plurality of parallel boards is attached to the first rail.

9. The playhouse kit of claim 7, wherein the first rail is an inner rail and wherein the second rail is an outer rail.

10. The playhouse kit of claim 9, further comprising a first vertical row of predrilled holes extending through the first rail and further comprising a second vertical row of predrilled holes extending through the first rail.

11. The playhouse kit of claim 7, wherein the second rail is an inner rail and wherein the first rail is an outer rail.

12. The playhouse kit of claim 11, further comprising a first vertical row of predrilled holes extending through the second rail and further comprising a second vertical row of predrilled holes extending through the second rail.

* * * * *